US009061810B2

(12) United States Patent
Brand

(10) Patent No.: US 9,061,810 B2
(45) Date of Patent: Jun. 23, 2015

(54) CARRIER FOR CONTAINERS

(75) Inventor: Kirsten L. Brand, Hackettstown, NJ (US)

(73) Assignee: Graphic Packaging International, Inc., Atlanta, GA (US)

( * ) Notice: Subject to any disclaimer, the term of this patent is extended or adjusted under 35 U.S.C. 154(b) by 1120 days.

(21) Appl. No.: 13/025,582

(22) Filed: Feb. 11, 2011

(65) Prior Publication Data

US 2011/0198347 A1 Aug. 18, 2011

Related U.S. Application Data

(60) Provisional application No. 61/338,002, filed on Feb. 12, 2010.

(51) Int. Cl.
*B65D 75/00* (2006.01)
*B65D 71/58* (2006.01)

(52) U.S. Cl.
CPC .. *B65D 71/0022* (2013.01); *B65D 2571/00141* (2013.01); *B65D 2571/00388* (2013.01); *B65D 2571/00487* (2013.01); *B65D 2571/00524* (2013.01); *B65D 2571/0066* (2013.01); *B65D 2571/00802* (2013.01)

(58) Field of Classification Search
USPC ..... 206/162, 167, 169, 170, 174, 175
See application file for complete search history.

(56) References Cited

U.S. PATENT DOCUMENTS

| | | | | |
|---|---|---|---|---|
| 2,225,822 | A | | 12/1940 | Crook |
| 2,227,330 | A | | 12/1940 | Turner |
| 2,331,312 | A | | 10/1943 | Dorfman |
| 2,336,857 | A | | 12/1943 | Gies et al. |
| 2,460,108 | A | | 1/1949 | Smith et al. |
| 2,689,061 | A | | 9/1954 | Gray |
| 2,702,144 | A | * | 2/1955 | Forrer ..... 206/171 |
| 2,721,001 | A | | 10/1955 | Hasselhoff |
| 2,776,072 | A | | 1/1957 | Forrer |
| 2,783,916 | A | | 3/1957 | Hodapp |
| 3,029,977 | A | | 4/1962 | Arneson |
| 3,053,411 | A | | 9/1962 | Struble et al. |

(Continued)

FOREIGN PATENT DOCUMENTS

| | | | |
|---|---|---|---|
| CN | 1741944 | A | 3/2006 |
| DE | 9004439 | U1 | 6/1990 |

(Continued)

OTHER PUBLICATIONS

International Search Report and Written Opinion dated Aug. 10, 2011, from PCT/US2011/024474.

(Continued)

*Primary Examiner* — Jacob K Ackun

(74) *Attorney, Agent, or Firm* — Womble Carlyle Sandridge & Rice, LLP

(57) ABSTRACT

A carrier for holding a plurality of containers. The carrier comprises a plurality of panels that extend at least partially around an interior of the carrier. The plurality of panels comprises at least one bottom panel, a front panel, a back panel, and at least two side panels. The interior of the carrier is divided into a front portion and a back portion. The carrier comprises a reinforced handle comprising a handle panel, a handle reinforcement panel at least partially overlapping the handle panel, and a handle reinforcement flap at least partially in face-to-face contact with the handle reinforcement panel.

4 Claims, 11 Drawing Sheets

(56) References Cited

U.S. PATENT DOCUMENTS

| | | | | |
|---|---|---|---|---|
| 3,128,906 | A | | 4/1964 | Forrer |
| 3,190,487 | A | | 6/1965 | Wood |
| 3,191,800 | A | | 6/1965 | Kowal |
| 3,194,478 | A | | 7/1965 | Weiss |
| 3,229,849 | A | | 1/1966 | Spillson |
| 3,236,414 | A | | 2/1966 | Slevin, Jr. |
| 3,313,466 | A | | 4/1967 | Keith |
| 3,343,742 | A | | 9/1967 | Siegler |
| 3,351,230 | A | | 11/1967 | Schuster |
| 3,432,073 | A | | 3/1969 | Forrer |
| 3,554,401 | A | | 1/1971 | Wood |
| 3,624,790 | A | | 11/1971 | Stout |
| 3,661,297 | A | | 5/1972 | Wood |
| 3,669,306 | A | | 6/1972 | Forrer |
| 3,672,539 | A | | 6/1972 | Forrer |
| 3,721,335 | A | | 3/1973 | Grant |
| 3,754,680 | A | | 8/1973 | Wood |
| 3,784,053 | A | | 1/1974 | Stout |
| 3,860,113 | A | | 1/1975 | Helms |
| 3,917,059 | A | | 11/1975 | Wood |
| 3,917,060 | A | | 11/1975 | Wood |
| 3,917,061 | A | | 11/1975 | Stout |
| 4,000,813 | A | | 1/1977 | Stout |
| 4,010,847 | A | | 3/1977 | Wood et al. |
| 4,117,925 | A | | 10/1978 | Wood |
| 4,153,158 | A | | 5/1979 | Graser et al. |
| 4,171,046 | A | | 10/1979 | Bonczyk |
| 4,205,748 | A | | 6/1980 | Wilson |
| 4,217,983 | A | | 8/1980 | Stout |
| 4,243,138 | A | | 1/1981 | Wilson |
| 4,250,992 | A | | 2/1981 | Gilbert |
| 4,253,564 | A | | 3/1981 | Engdahl, Jr. |
| 4,308,950 | A | | 1/1982 | Wood |
| 4,319,682 | A | | 3/1982 | Wright et al. |
| 4,362,240 | A | | 12/1982 | Elward |
| 4,374,561 | A | | 2/1983 | Stout et al. |
| 4,406,365 | A | | 9/1983 | Kulig |
| 4,413,729 | A | | 11/1983 | Wood |
| 4,450,956 | A | | 5/1984 | Wood |
| 4,480,746 | A | | 11/1984 | Wood |
| 4,544,092 | A | | 10/1985 | Palmer |
| 4,591,090 | A | | 5/1986 | Collins et al. |
| 4,722,437 | A | | 2/1988 | Walsh |
| 4,770,294 | A | | 9/1988 | Graser |
| 4,792,038 | A | | 12/1988 | Cooper |
| 4,798,285 | A | | 1/1989 | Hernandez |
| 4,927,009 | A | | 5/1990 | Stout |
| 5,029,698 | A | | 7/1991 | Stout |
| 5,040,672 | A | | 8/1991 | DeMaio et al. |
| 5,072,876 | A | | 12/1991 | Wilson |
| 5,123,588 | A | | 6/1992 | Harris |
| 5,191,976 | A | | 3/1993 | Stout et al. |
| 5,246,113 | A | | 9/1993 | Schuster |
| 5,282,348 | A | | 2/1994 | Dampier et al. |
| 5,359,830 | A | | 11/1994 | Olson et al. |
| 5,363,954 | A | | 11/1994 | Dampier et al. |
| 5,400,901 | A | | 3/1995 | Harrelson |
| 5,458,234 | A | | 10/1995 | Harris |
| 5,482,203 | A | | 1/1996 | Stout |
| 5,484,053 | A | | 1/1996 | Harris |
| 5,499,712 | A | | 3/1996 | Harrelson |
| 5,518,110 | A | | 5/1996 | Harrelson |
| 5,531,319 | A | | 7/1996 | Harrelson |
| 5,538,130 | A | | 7/1996 | Harrelson |
| 5,538,131 | A | | 7/1996 | Harrelson |
| 5,579,625 | A | | 12/1996 | Olson et al. |
| 5,579,904 | A | * | 12/1996 | Holley, Jr. ..... 206/180 |
| 5,590,762 | A | | 1/1997 | Harrelson |
| 5,593,027 | A | | 1/1997 | Sutherland |
| 5,620,094 | A | | 4/1997 | Naumann |
| 5,638,956 | A | | 6/1997 | Sutherland |
| 5,645,162 | A | | 7/1997 | Harrelson |
| 5,649,620 | A | | 7/1997 | Harrelson |
| 5,657,864 | A | | 8/1997 | Harrelson |
| 5,657,865 | A | | 8/1997 | Harrelson |
| 5,680,930 | A | | 10/1997 | Stone |
| 5,682,982 | A | | 11/1997 | Stonehouse |
| 5,695,051 | A | | 12/1997 | Hart |
| 5,765,685 | A | | 6/1998 | Roosa |
| 5,775,487 | A | | 7/1998 | Harrelson |
| 5,819,920 | A | | 10/1998 | Sutherland |
| 5,855,316 | A | | 1/1999 | Spivey |
| 5,871,090 | A | | 2/1999 | Doucette et al. |
| 5,878,877 | A | | 3/1999 | Sutherland |
| 5,884,756 | A | | 3/1999 | Holley, Jr. et al. |
| 5,947,273 | A | | 9/1999 | Dalrymple et al. |
| 6,041,920 | A | | 3/2000 | Hart et al. |
| 6,112,977 | A | | 9/2000 | Sutherland et al. |
| 6,131,729 | A | | 10/2000 | Eckermann et al. |
| 6,155,962 | A | | 12/2000 | Dalrymple et al. |
| 6,168,013 | B1 | | 1/2001 | Gomes |
| 6,230,881 | B1 | | 5/2001 | Collura |
| 6,247,585 | B1 | | 6/2001 | Holley, Jr. |
| 6,315,111 | B1 | | 11/2001 | Sutherland |
| 6,341,689 | B1 | | 1/2002 | Jones |
| 6,371,287 | B1 | | 4/2002 | Jones et al. |
| 6,695,137 | B2 | | 2/2004 | Jones et al. |
| 6,736,260 | B2 | | 5/2004 | Gomes et al. |
| 6,802,802 | B2 | | 10/2004 | Woog |
| 6,814,228 | B2 | | 11/2004 | Sutherland |
| 6,938,756 | B2 | | 9/2005 | Schuster |
| 7,011,209 | B2 | | 3/2006 | Sutherland et al. |
| 7,025,197 | B2 | | 4/2006 | Sutherland |
| 7,070,045 | B2 | | 7/2006 | Theelen |
| 7,128,206 | B2 | | 10/2006 | Kohler |
| 7,207,934 | B2 | | 4/2007 | Schuster |
| 7,374,038 | B2 | | 5/2008 | Smalley |
| 7,448,492 | B2 | | 11/2008 | Sutherland |
| 7,472,791 | B2 | | 1/2009 | Spivey, Sr. |
| 7,552,820 | B2 | | 6/2009 | Kohler |
| 7,604,116 | B2 | | 10/2009 | Schuster |
| 7,644,817 | B2 | | 1/2010 | Sutherland |
| 7,677,387 | B2 | | 3/2010 | Brand et al. |
| 7,762,395 | B2 | | 7/2010 | Sutherland et al. |
| 7,762,397 | B2 | | 7/2010 | Coltri-Johnson et al. |
| 7,793,780 | B2 | | 9/2010 | Smalley |
| 2002/0077236 | A1 | | 6/2002 | Chalendar et al. |
| 2002/0117407 | A1 | | 8/2002 | Holley |
| 2003/0159950 | A1 | | 8/2003 | Jones et al. |
| 2004/0050722 | A1 | | 3/2004 | Schuster |
| 2004/0094435 | A1 | | 5/2004 | Auclair et al. |
| 2005/0211577 | A1 | | 9/2005 | Bakx |
| 2005/0218014 | A1 | | 10/2005 | Schuster |
| 2005/0230273 | A1 | | 10/2005 | Kohler |
| 2006/0148629 | A1 | | 7/2006 | Cuomo |
| 2006/0157545 | A1 | | 7/2006 | Auclair |
| 2007/0151873 | A1 | | 7/2007 | Schuster |
| 2008/0210581 | A1 | | 9/2008 | Brand |
| 2008/0296177 | A1 | * | 12/2008 | Cuomo ..... 206/173 |
| 2009/0008273 | A1 | * | 1/2009 | Smalley ..... 206/189 |
| 2010/0006458 | A1 | | 1/2010 | Wilkins et al. |

FOREIGN PATENT DOCUMENTS

| | | | |
|---|---|---|---|
| EP | 0 074 232 | A2 | 3/1983 |
| EP | 1 319 607 | A1 | 6/2003 |
| JP | H07-8216 | U | 2/1995 |
| WO | WO 95/09780 | A1 | 4/1995 |
| WO | WO-97/05026 | A1 | 2/1997 |
| WO | WO 99/42383 | | 8/1999 |

OTHER PUBLICATIONS

Notification of the First Office Action and Search Report for CN 201180008554.0 dated Nov. 25, 2013, with English translation.

International Search Report and Written Opinion dated Jun. 23, 2010 for PCT/US2010/039607.

Supplementary European Search Report for Ep 11 74 2845 dated Nov. 4, 2014.

* cited by examiner

CARRIER FOR CONTAINERS

CROSS-REFERENCE TO RELATED APPLICATIONS

This application claims the benefit of U.S. Provisional Patent Application No. 61/338,002, filed Feb. 12, 2010.

INCORPORATION BY REFERENCE

U.S. Provisional Patent Application No. 61/338,002, which was filed on Feb. 12, 2010, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier comprises panels that extend at least partially around an interior of the carrier. The panels comprise at least one bottom panel, a front panel, a back panel, and at least two side panels. The interior of the carrier is divided into a front portion and a back portion. The carrier comprises a reinforced handle comprising a handle panel, a handle reinforcement panel at least partially overlapping the handle panel, and a handle reinforcement flap at least partially in face-to-face contact with the handle reinforcement panel.

In another aspect, the disclosure is generally directed to a blank for forming a carrier for holding a plurality of containers. The blank comprises a plurality of panels comprising at least one bottom panel, a front panel, a back panel, and at least two side panels. The blank also comprises features for forming a reinforced handle comprising a handle panel, a handle reinforcement panel, and a handle reinforcement flap foldably connected to the handle reinforcement panel along a first longitudinal fold line. The handle panel and the handle reinforcement panel generally extending along a centerline of the blank.

In another aspect, the disclosure is generally directed to a method of forming a carrier for containing a plurality of containers. The method comprises obtaining a blank comprising a plurality of panels comprising at least one bottom panel, a front panel, a back panel, and at least two side panels. The blank further includes a handle panel, a handle reinforcement panel, and a handle reinforcement flap. The handle reinforcement flap is foldably connected to the handle reinforcement panel along a first longitudinal fold line. The method further comprises folding the handle reinforcement flap along the first longitudinal fold line so that the handle reinforcement flap is at least partially in face-to-face contact with the handle reinforcement panel, and folding the plurality of panels to selectively overlap respective panels of the plurality of panels. The folding the plurality of panels comprises at least partially overlapping the handle reinforcement panel with the handle panel. The method further comprises forming a reinforced handle by folding the handle panel, the handle reinforcement panel, and the handle reinforcement flap along a longitudinal centerline, and forming an interior of the carrier by further respectively folding the plurality of panels, the interior of the carrier being divided into a front portion and a back portion.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms "lower," "bottom," "upper," "top," "front," and "back" indicate orientations determined in relation to fully erected carriers.

Figure 1:
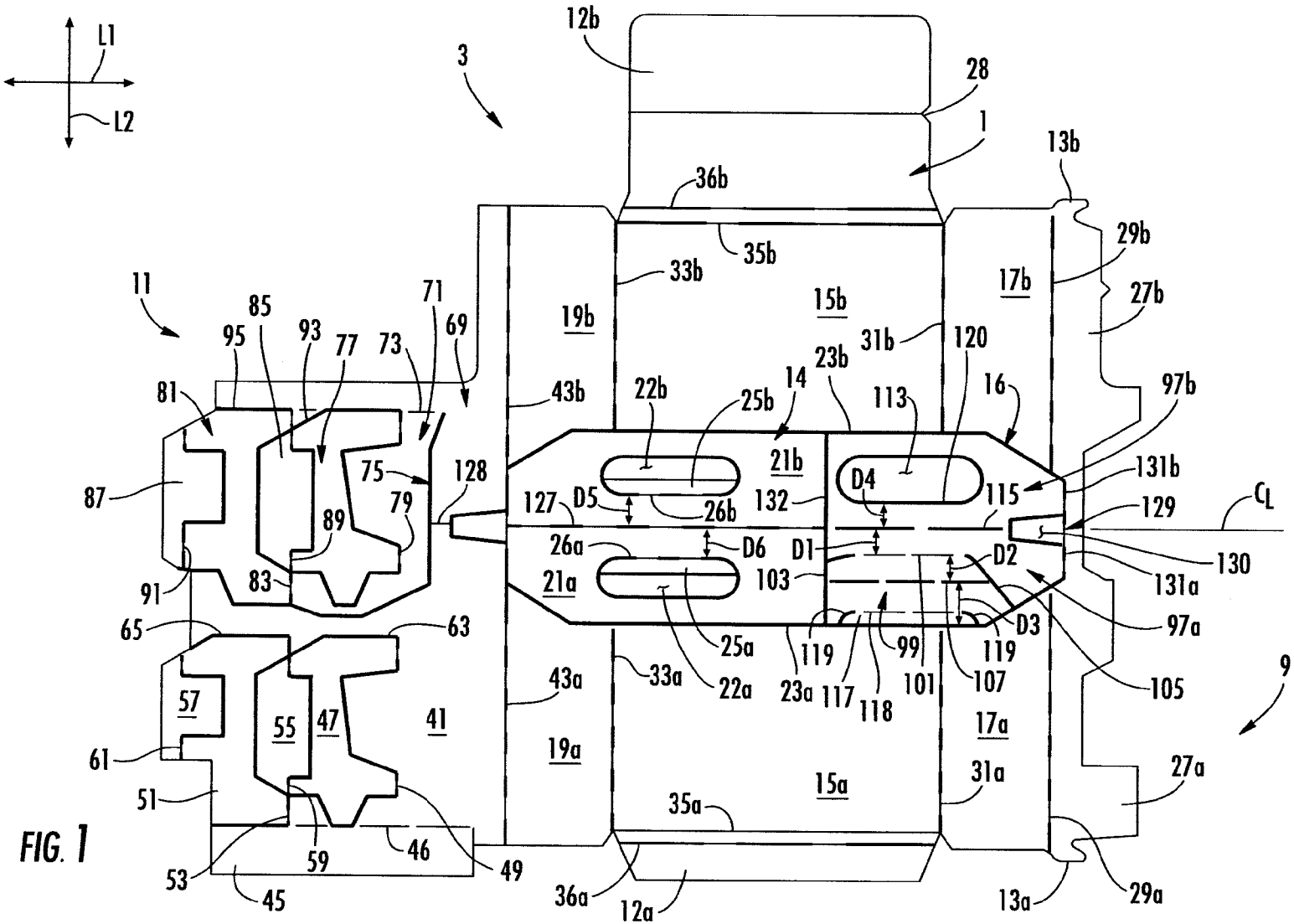
FIG. 1 is an exterior plan view of a blank used to form a carrier according to a first embodiment of the disclosure.

FIG. 1 is a plan view of an exterior side 1 of the blank 3 used to form a package or basket-style carrier 5 (FIGS. 5A, 5B, and 5C), in accordance with a first embodiment of the present disclosure. As shown in FIGS. 5A, 5B, and 5C, the carrier 5 is sized to contain six containers C, three containers being contained in a front portion of the carrier (FIG. 5A) and three containers being contained in a back portion of the carrier (FIG. 5B). The carrier can be sized and shaped to hold more or less than six containers C without departing from the disclosure. In the illustrated embodiment, the carrier 5 includes a reinforced handle 150 (FIGS. 4, 5A, and 5B), which can include a handle panel 14 and a handle reinforcement panel 16.

The carrier blank 3 has a longitudinal axis L1 and a lateral or transverse axis L2. The carrier blank 3 has a front portion 9, a back portion 11, a bottom panel 12*b* foldably connected to the back portion, and a bottom attachment flap 12*a* foldably connected to the front portion. In the illustrated embodiment, the front portion 9 and back portion 11 are for being folded about a longitudinal centerline CL (FIG. 1) when the carrier blank 3 is formed into the carrier 5. As discussed in more detail below, the carrier blank 3 is formed into the carrier 5 by folding the carrier blank about the centerline CL so that the front portion 9 and the back portion 11 are generally overlapped.

In the illustrated embodiment, the front portion 9, comprises a front panel 15*a* foldably connected to a first side panel 17*a* and a second side panel 19*a*. A front central flap 27*a* is foldably connected to the first side panel 17*a* at a lateral fold line 29*a*. Lateral fold lines 31*a*, 33*a*, foldably connect the respective first and second side panel 17*a*, 19*a* to the front panel 15*a*. Two longitudinal folds line 35*a*, 36*a* connect the bottom panel attachment flap 12*a* to the front panel 15*a*.

In the illustrated embodiment, the features of the back portion 11 of the blank 3 include a back panel 15*b*, a first side panel 17*b*, and a second side panel 19*b*, that are generally a mirror-image of the corresponding panel or flap of the front portion 9. A back central flap 27*b* is also similarly configured to the front central flap 27*a*, and a longitudinal fold line 129 foldably connects the front central flap 27*a* to the back central flap 27*b*. Corresponding components (e.g., panels, flaps, fold lines, cuts, etc.) have been designated by corresponding reference numbers that differ by the "a" or "b" suffix, with the "a" components corresponding to the front portion 9 and the "b" components corresponding to the back portion 11 of the blank 3.

In one embodiment, the front portion 9 includes a front central panel 41 foldably connected to the second side panel 19*a* at a lateral fold line 43*a*. The central panel 41 includes a central bottom flap 45 foldably connected to the front central panel 41 along a longitudinal fold line 46. A first divider flap 47 is foldably connected to the front central panel 41 at a lateral fold line 49. A second divider flap 51 is foldably connected to the front central panel 41 at a lateral fold line 53. The first divider flap 47 includes a first attachment flap 55, and the second divider flap 51 includes a second attachment flap 57. The first attachment flap 55 is foldably connected to the first divider flap at a lateral fold line 59, and the second attachment flap 57 is foldably connected to the second divider flap at a lateral fold line 61. The first divider flap 47 is at least partially defined by a tear or cut line 63 and the lateral fold line 49. The second divider flap 51 is at least partially defined by the lateral fold line 53 and a tear or cut line 65 that extends from a lateral edge of the blank 3 to the fold line 53. The divider flaps 47, 51 could be otherwise shaped, arranged, and/or configured without departing from the disclosure.

The back portion 11 includes a back central panel 69 foldably connected to the second side panel 19*b* at a lateral fold line 43*b*. The back central panel 69 can include a divider panel 71 foldably connected to the back central panel 69 along a longitudinal fold line 73 and separable from the front and back central panels 41, 69 along a tear or cut line 75. A first divider flap 77 is foldably connected to the divider panel 71 at a lateral fold line 79, and a second divider flap 81 is foldably connected to the divider panel 71 at a lateral fold line 83. Each divider flap 77, 81 includes a respective attachment flap 85, 87 foldably connected to a respective divider flap at a lateral fold line 89, 91. The first divider flap 77 is at least partially defined by a tear or cut line 93 and the lateral fold line 79. The second divider flap 81 is at least partially defined by the cut line 75, the lateral fold line 83, and a tear or cut line 95 that extends from a lateral edge of the blank 3 to the fold line 83. In the illustrated embodiment, the front central panel 41 is foldably connected to the back central panel 69 along a line of weakening 128, which can include a fold line and an opening. The front portion 9, the back portion 11, the central flaps 27*a*, 27*b*, the central panels 41, 69, and/or the divider flaps 47, 51, 77, 81 could be alternatively shaped, arranged, and/or configured, or could be omitted, without departing from the present disclosure.

In the illustrated embodiment, the handle panel 14 and the handle reinforcement panel 16 are generally disposed between the front and back portions 9, 11. The handle panel 14 includes a front handle portion 21*a* and a back handle portion 21*b* foldably connected to the front handle portion 21*a* along a longitudinal fold line or other line of weakening 127. The front handle portion 21*a* is foldably connected to the front central panel 41 along the lateral fold line 43*a*, and the back handle portion 21*b* is foldably connected to the back central panel 69 along the lateral fold line 43*b*. The front handle portion 21*a* can include a front handle opening 22*a* and a front handle cushion flap 25*a* foldably connected to the front handle portion along a longitudinal fold line 26*a* adjacent the front handle opening 22*a*. The back handle portion 21*b* can include a back handle opening 22*b* and a back handle cushion flap 25*b* foldably connected to the back handle portion along a longitudinal fold line 26*b* adjacent the back handle opening 22*b*. The handle panel 14 could be otherwise shaped, arranged, and/or configured, or could be omitted, without departing from the disclosure.

The handle reinforcement panel 16 can include a front handle reinforcement portion 97*a* and a back handle reinforcement portion 97*b* foldably connected to the front handle reinforcement portion 97*a* along a longitudinal fold line or other line of weakening 115. An opening 130 can be included between the handle reinforcement portions 97*a*, 97*b*. The front handle reinforcement portion 97*a* is foldably connected to the front central flap 27*a* along a lateral fold line 131*a*, and the back handle reinforcement portion 97*b* is foldably connected to the back central flap 27*b* along a lateral fold line 131*b*. In the illustrated embodiment, the lateral fold lines 131*a*, 131*b* are spaced apart or offset from the lateral fold lines 29*a*, 29*b* connecting the respective front and back central flaps 27*a*, 27*b* to the respective first side panels 17*a*, 17*b*. Alternatively, the lateral fold lines 131*a*, 131*b* can be collinear with the lateral fold lines 29*a*, 29*b*. In the illustrated embodiment, the front handle reinforcement portion 97*a* includes a handle reinforcement flap 99, and the back handle reinforcement portion 97*b* includes an elongate handle opening 113.

The handle reinforcement flap 99 can be foldably connected to the front handle reinforcement portion 97*a* by a longitudinal fold line 101. In the first embodiment, the reinforcement flap 99 is separated from the front handle reinforcement portion 97*a* by respective cuts 103, 105. The handle reinforcement flap 99 includes a fold line or other line of weakening 107 and a central handle cushion flap 117. The central handle cushion flap 117 can be foldably connected to the handle reinforcement flap 99 along a longitudinal fold line 118 and can be separated from handle reinforcement flap at cut or tear lines 119. The handle reinforcement panel 16 could be otherwise shaped, arranged, and/or configured, or could be omitted, without departing from the disclosure. For example, the fold lines 107, 115 could be other forms of weakening, such as one including a series of openings and fold lines.

In the illustrated embodiment, the line of weakening 128 and the longitudinal fold lines 115, 127, 129 are generally aligned with the longitudinal centerline CL of the blank 3. The front handle portion 21*a* is adjacent the front panel 15*a* and the second side panel 19*a*, and the front handle reinforcement portion 97*a* is adjacent the front panel 15*a* and the first side panel 17*a*. The front handle portion 21*a* and the front handle reinforcement portion 97*a* are separated from the front panel 15*a* and the respective second side panel 19*a* and first side panel 17*a* by a cut 23*a*. Similarly, the back handle portion 21*b* and the back handle reinforcement portion 97*b* are separated from the back panel 15*b* and the respective second side panel 19*b* and first side panel 17*b* by a cut 23*b*. In the illustrated embodiment, the front and back handle reinforcement portions 97*a*, 97*b* are separable from the respective handle portions 21*a*, 21*b* along a tear or cut line 132. Alternatively, the handle reinforcement portions can be spaced apart from the handle portions. Further, the handle portions, the handle reinforcement portions, and the handle reinforcement flap could be otherwise shaped, arranged, and/or configured, or could be omitted, without departing from the disclosure.

In the illustrated embodiment, the longitudinal fold line 101 can be spaced apart from the longitudinal fold line 115 a distance D1, and the longitudinal fold line 107 can be spaced apart from the longitudinal fold line 101*a* distance D2. The distance D1 can be substantially equal to the distance D2 so that the fold line 107 overlays the fold line 115 when the handle reinforcement flap 99 is folded along the longitudinal fold line 101. Additionally, the longitudinal fold line 107 can be spaced apart from the cut 23*a* a distance D3, and the upper edge of the handle opening 113 can be spaced apart from the longitudinal fold line 115 a distance D4. In the illustrated embodiment, the distance D3 is greater than the distance D4 so that a portion (e.g., the central handle cushion flap 117) of the handle reinforcement flap 99 overlays the handle opening 113 when the handle reinforcement flap 99 is folded along the longitudinal fold line 101. In an alternative embodiment, distance D4 can be generally equal to distance D3. Additionally, in one embodiment, the distance D4 can be substantially equal to the distance D1.

The fold line 26*b*, extending along the upper edge of the back handle opening 22*b*, can be spaced apart from the longitudinal fold line 127 a distance D5 that is generally equal to or greater than the distance D4 between the upper edge of the handle opening 113 and the longitudinal fold line 115 so that the back handle opening 22*b* is aligned with the handle opening 113 when the reinforced handle 150 is formed. The handle opening 113 can be larger than the back handle opening 22*b* so that substantially all of the back handle opening 22*b* positioned within the handle opening 113 regardless of variations in alignment of the handle panel 14 and the handle reinforcement panel 16 when the reinforced handle 150 is formed. Additionally, the fold line 26*a*, extending along the upper edge of the front handle opening 22*a*, can be spaced apart from the longitudinal fold line 127 a distance D6 that is generally equal to or greater than the distance D1 between the longitudinal fold lines 101, 115 so that substantially all of the front handle opening 22*a* is positioned within a recess in the front handle reinforcement portion 97*a* formed when the handle reinforcement panel 99 is folded along the longitudinal fold line 101. In one embodiment, the distance D5 can be substantially equal to the distance D6. The distances can be alternatively configured without departing from the present disclosure.

Any of the panels, flaps, fold lines, cuts, or other features could be otherwise shaped, arranged, and/or omitted from the blank 3 without departing from the disclosure. The blank 3 could be sized and/or shaped to accommodate more or less than six containers C without departing from this disclosure.

Figure 2:
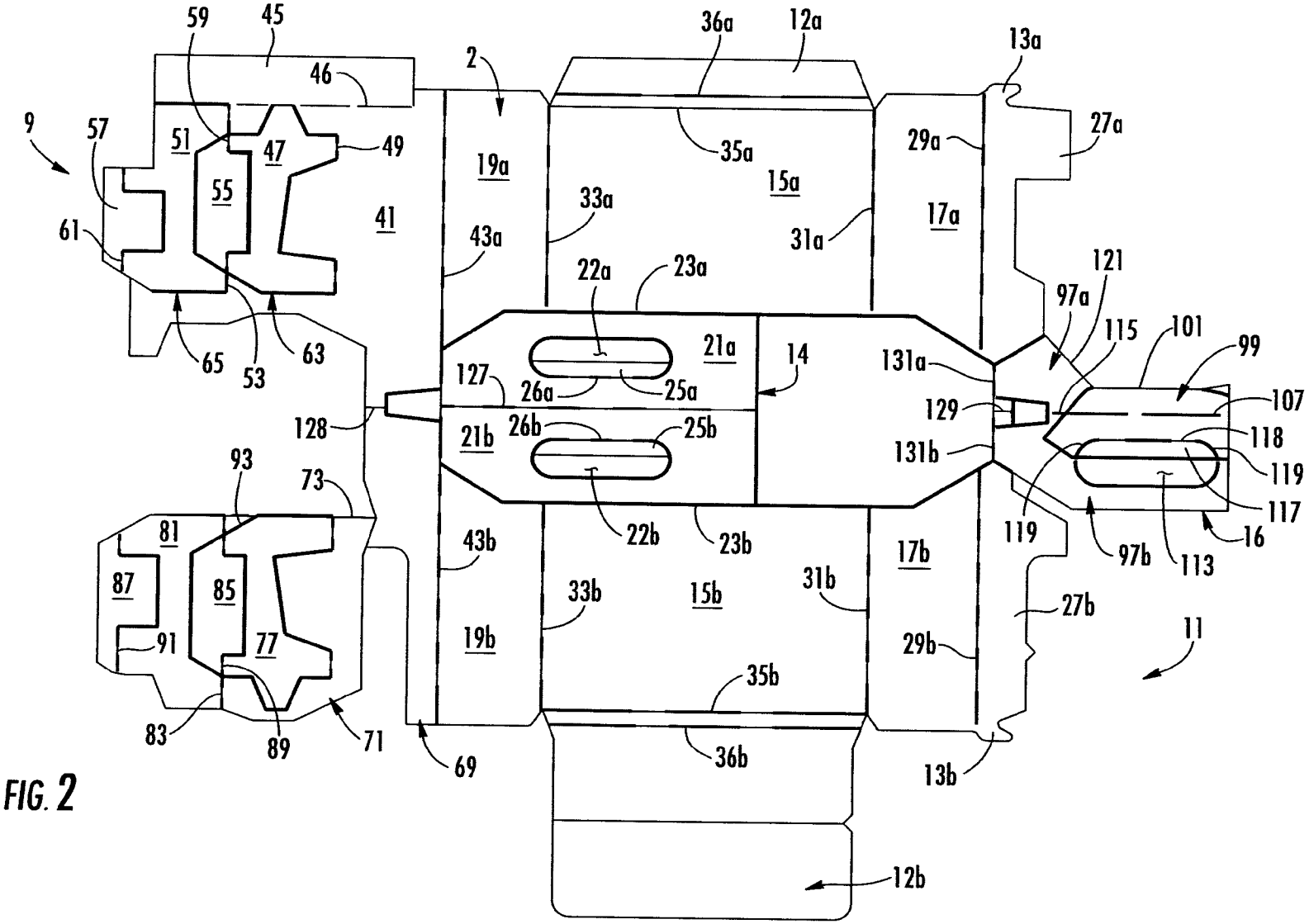
FIGS. 2-4 are views showing folding of the blank of FIG. 1 to form the carrier according to the first embodiment.
Figure 3:
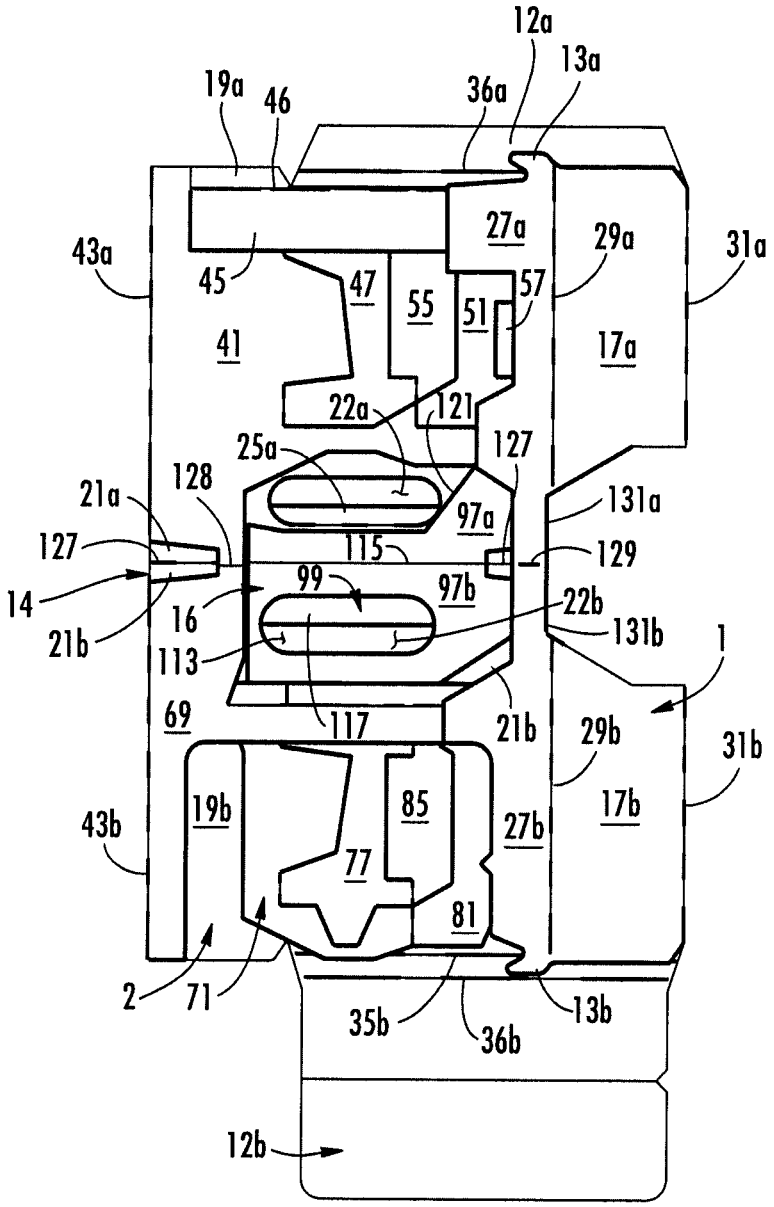
Figure 4:
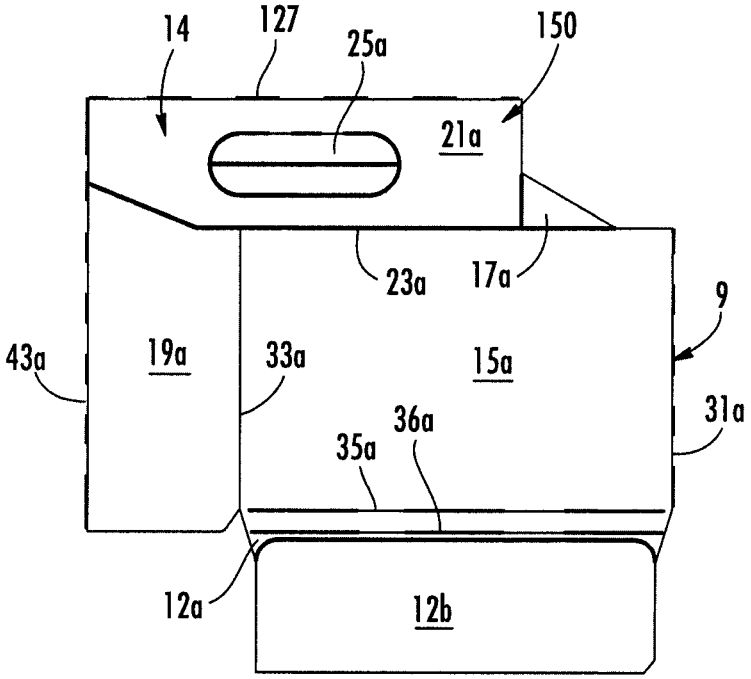
Figure 5A:
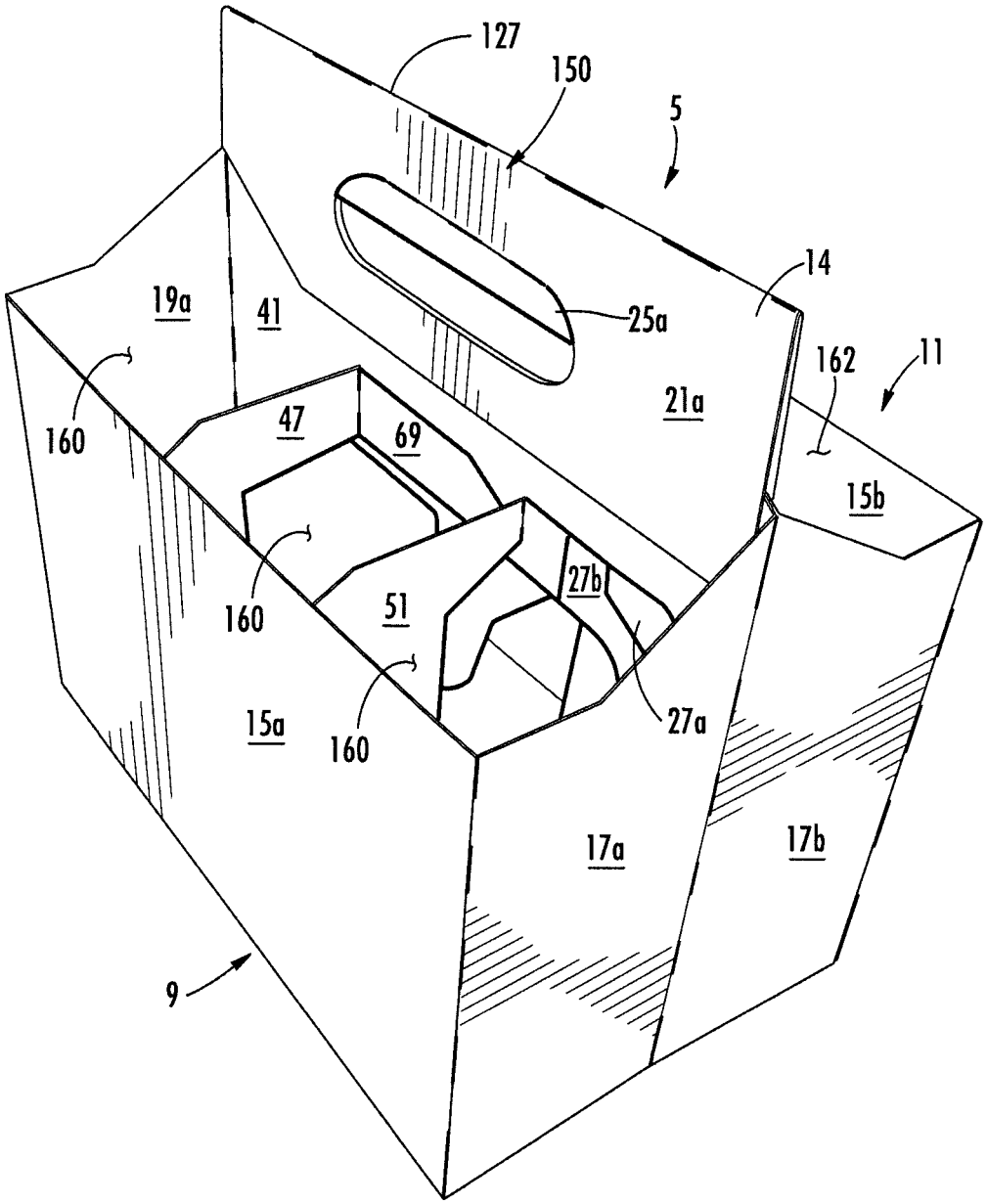
FIGS. 5A-5C are perspective views of the assembled carrier according to the first embodiment.
Figure 5B:
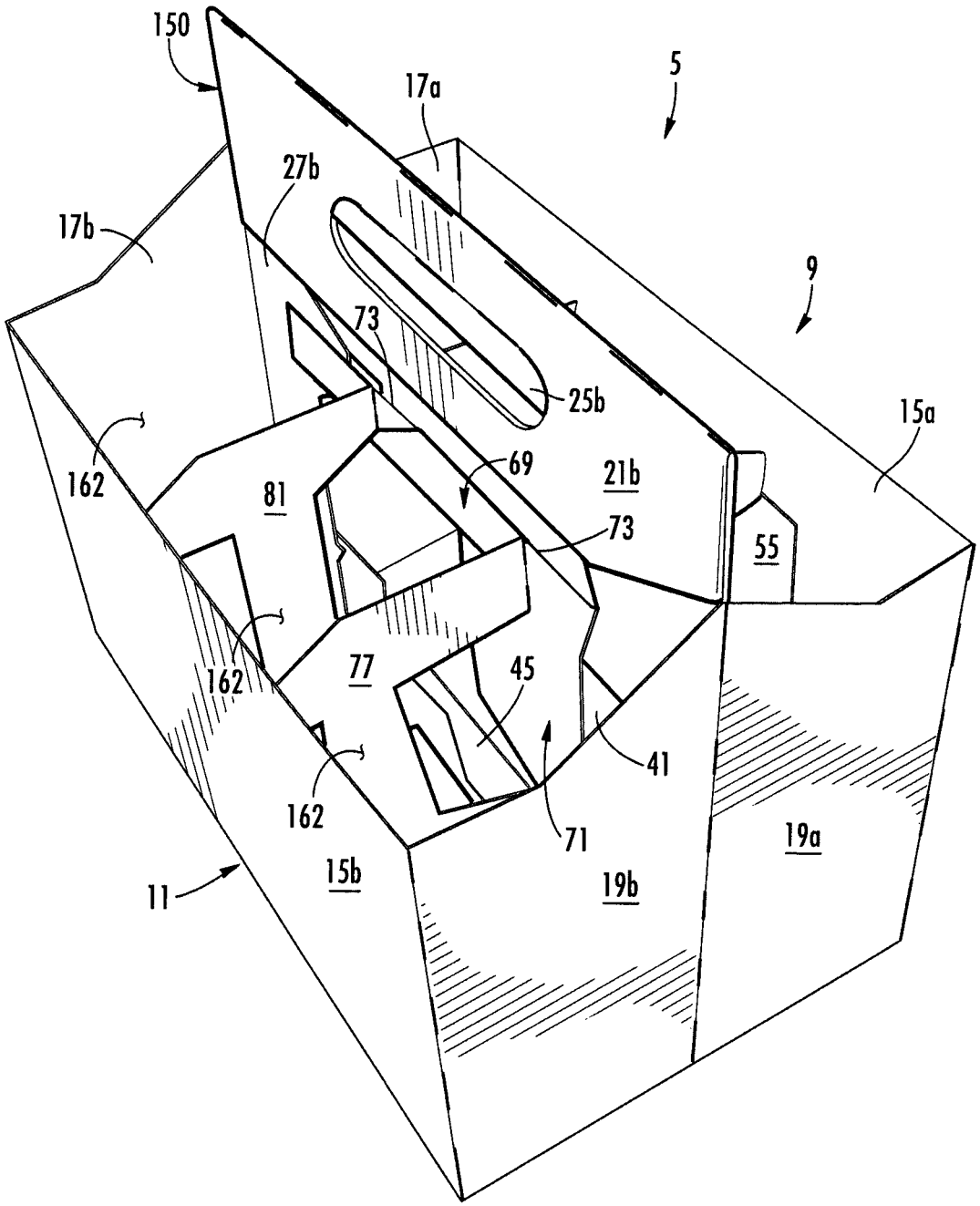
Figure 5C:
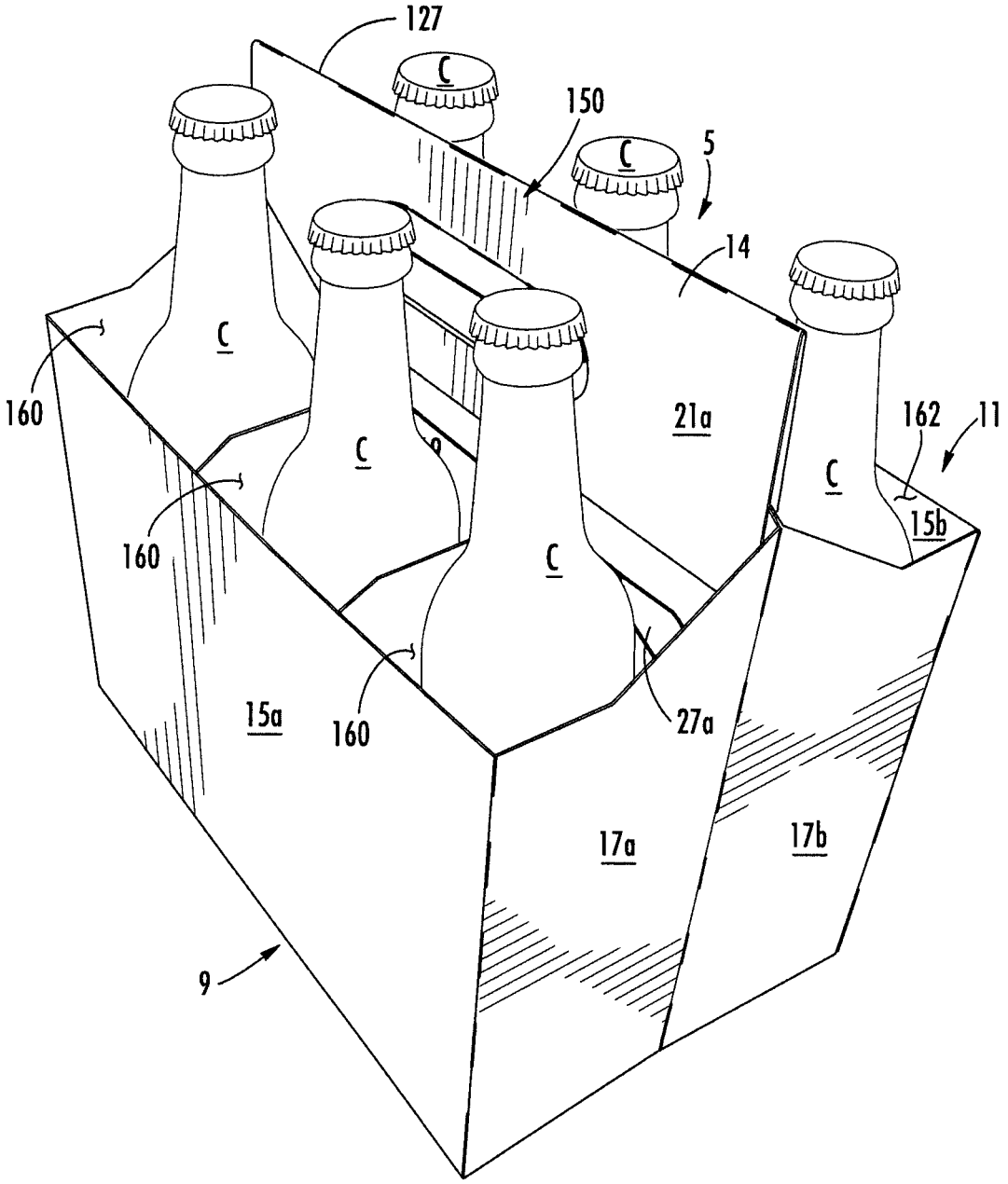

With reference to FIGS. 2-4, in one exemplary method of erection, the carrier 5 can be erected from the blank 3 by positioning the panels 15*a*, 15*b*, 17*a*, 17*b*, 19*a*, 19*b*, and the dividers 47, 51, 87, 91 relative to each other to form the front portion 9 of the carrier and the back portion 11 of the carrier. Particularly, FIG. 2 generally shows an interior surface 2 of the blank 3 after exemplary first folds of the blank, including folding the divider panel 71 along the longitudinal fold line 73 so that at least a portion of the divider panel is in face-to-face contact with the interior surface of the lower portion of the back central panel 69. The handle reinforcement panel 16 also can be folded along lateral fold lines 131*a*, 131*b* so that at least a portion of each of the front and back handle reinforcement portions 97*a*, 97*b* is in face-to-face contact with a portion of the interior surface of the respective front and back central flaps 27*a*, 27*b*. The front and back handle reinforcement portions 97*a*, 97*b* can be glued to the front and back central flaps 27*a*, 27*b*. The handle reinforcement flap 99 can be folded along the longitudinal fold line 101 to be in at least partially face-to-face contact with the exterior surface of the handle reinforcement panel 16. Particularly, the fold line 107 is generally aligned with and overlays the fold line 115 so that respective portions of the reinforcement flap 99 are in contact with a portion of the front handle reinforcement portion 97*a* and a portion of the back handle reinforcement portion 97*b* to form a two-ply combined handle reinforcement panel. As shown in FIG. 2, the central handle cushion flap 117 is disposed adjacent the handle opening 113 in the back handle reinforcement portion 97*b*, and the longitudinal fold line 118 is generally aligned with and overlays an upper edge 120 of the handle opening 113. An opening or recess 121 can be defined by the fold line 101 and the edges of the front handle reinforcement portion 97*a* formed by the cuts 103, 105 after folding the handle reinforcement flap 99. The handle reinforcement flap 99 can be glued to the front handle reinforcement portion 97*a* and/or the back handle reinforcement portion 97*b*.

As shown in FIG. 3, the central bottom flap 45 can be folded along the longitudinal fold line 46 so that the central bottom flap is in face-to-face contact with the exterior surface 1 of the front central panel 41. The front and back central panels 41, 69 can be folded about respective fold lines 43*a*, 43*b* so that the central panels are generally in face-to-face relationship with portions of the respective handle portions 21*a*, 21*b*, the respective second side panels 19*a*, 19, and the respective front and back panels 15*a*, 15*b*. The line of weakening 128 is generally aligned with and overlays the longitudinal fold line 127 of the handle panel 14. Glue or other adhesive is selectively applied to the blank 3 to adhesively connect the attachment flaps 55, 57 to the front panel 15*a* and to adhesively connect the attachment flaps 85, 87 to the back panel 15*b*. Additionally, in one particular embodiment, the portions of the central panels 41, 69 in face-to-face contact with the respective front and back handle portions 21*a*, 21*b* can be adhered or otherwise secured to the handle portions.

In one embodiment, the first side panels 17*a*, 17*b* can be folded about respective fold lines 31*a*, 31*b* so that the first side panels 17*a*, 17*b* and central flaps 27*a*, 27*b* are generally in face-to-face contact with portions of the respective front and back central panels 41, 69. Portions of the front central flap 27*a* can be selectively glued to portions of the front central panel 41 and the central bottom flap 45, and portions of the back central flap 27*b* can be selectively glued to portions of the back central panel 69. The handle reinforcement panel 16 is at least partially in face-to-face contact with the handle panel 14, with the handle reinforcement flap 99 between portions of the front and back handle reinforcement portions

97*a*, 97*b* and the respective front and back handle portions 21*a*, 21*b*. Portions of the front and back reinforcement panels 97*a*, 97*b* also can be in face-to-face contact with portions of the front and back handle portions 21*a*, 21*b*. The front and back handle reinforcement portions 97*a*, 97*b* and the handle reinforcement flap 99 can be glued to the front and back handle portions 21*a*, 21*b* to at least partially secure the handle reinforcement panel 16 to the handle panel 14. The handle opening 113 is generally aligned with the back handle opening 22*b* so that the central handle cushion flap 117 is generally aligned with the back handle cushion flap 25*b* with the fold line 118 generally aligned with the upper edge of the back handle opening 22*b* (e.g., the fold line 26*b*). In the illustrated embodiment, the edge of the handle reinforcement panel 16 formed by the longitudinal fold line 101 is generally aligned with and overlays the fold line 26*a* connecting the front handle cushion flap 25*a* to the front handle portion 21*a* at an upper edge of the front handle opening 22*a* so that at least a portion of the front handle opening 22*a* is proximate the recess 121 of the front handle reinforcement portion 97*a*. The longitudinal fold lines 107, 115, 129 and the line of weakening 128 overlay the longitudinal fold line 127, and the fold lines 107, 115, 127, 129 and the line of weakening 128 remain generally aligned with the centerline CL.

In one embodiment, the partially assembled blank 3 of FIG. 3 is folded about the longitudinal centerline CL (i.e., the longitudinal fold lines 107, 115, 127, 129 and the line of weakening 128) so that the front portion 9 generally overlaps the back portion 11 (FIG. 4). Portions of the front central panel 41 and the front central flap 27*a* can be selectively glued to portions of the respective back central panel 69 and back central flap 27*b* to generally form a central wall between the front portion 9 and the back portion 11. The handle panel 14, the handle reinforcement panel 16, and the handle reinforcement flap 99 combine to form the six-ply reinforced handle 150 with the front handle opening 22*a* being generally aligned with the back handle opening 22*b* and the handle opening 113 of the back handle reinforcement portion 97*b*. The central handle cushion flap 117 can also be aligned with and disposed between the front and back handle cushion flaps 25*a*, 25*b*. The six-ply reinforced handle 150 comprises six plies or layers of material at least between the upper edges of the handle openings 22*a*, 22*b* to the longitudinal fold line 127. The six plies can include the folded over reinforcement flap 99 (two layers comprising a respective portion of the flap on either side of the fold line 107), the front handle reinforcement portion 97*a*, the back handle reinforcement portion 97*b*, the front handle portion 21*a*, and the back handle portion 21*b*. The reinforced handle 150 of the carrier 5 could be otherwise shaped, arranged, and/or configured without departing from the disclosure. The bottom panel 12*b* can be folded along a fold line and attached to the bottom panel attachment flap 12*a* by glue so that the partially assembled blank 3 has the configuration shown in FIG. 4.

The blank 3 can be further assembled into the carrier 5, as shown in FIGS. 5A and 5B, by positioning the first side panels 17*a*, 17*b* and second side panels 19*a*, 19*b* to be in a generally spaced-apart, parallel planar relationship, and positioning the front panel 15*a* and back panel 15*b* to be in a generally spaced-apart, parallel planar relationship. Such movement of the side panels 17*a*, 17*b*, 19*a*, 19*b* and front and back panels 15*a*, 15*b*, causes the divider flaps 47, 51 in the front portion 9 of the carrier 5 to be positioned generally perpendicular to the central panel 41 and the front panel 15*a*, thereby dividing the front portion 9 into three container-receiving spaces 160 (FIG. 5A). Similarly, the back portion 11 of the carrier is divided into three container-receiving spaces 162 by the divider flaps 77, 81 (FIG. 5B). The separating of the front and back panels 15*a*, 15*b* further pulls the bottom panel 12*b* flat across the bottom of the carrier 5. Two hooks 13*a*, 13*b* disposed at the bottoms of the respective central flaps 27*a*, 27*b* can engage a notch 28 in the bottom panel 12*b* for supporting the bottom panel.

The reinforced handle 150 and the carrier 5 can be alternatively erected, formed, and/or arranged without departing from the present disclosure. For example, in an alternative embodiment, the handle reinforcement flap 99 is folded into face-to-face contact with the interior surface of the handle reinforcement panel 16 so that the handle reinforcement flap 99 is interior to both the handle panel 14 and the handle reinforcement panel 16.

In one embodiment, containers C, such as bottles, can be placed into the container-receiving spaces 160, 162 of the carrier 5 prior to folding the bottom panel 12*b* to close the bottom of the carrier 5. The bottoms of the containers are supported by the bottom panel 12*b*.

The exemplary carrier embodiment discussed above accommodates six containers C arranged in two rows, but the present disclosure is not limited to these numbers. As one example, additional containers may be accommodated by increasing the size of the blank 3 (e.g., in the longitudinal direction L1 in FIG. 1) and forming additional container-receiving spaces therein. Also, the carrier 5 could have less than six container-receiving spaces.

The panels, flaps, and dividers shown and described in conjunction with the blank 3 and the carrier 5 are included by way of example. The reinforced handle 150 can alternatively be associated with any basket-style carrier having any divider or panel configuration.

Figure 6:
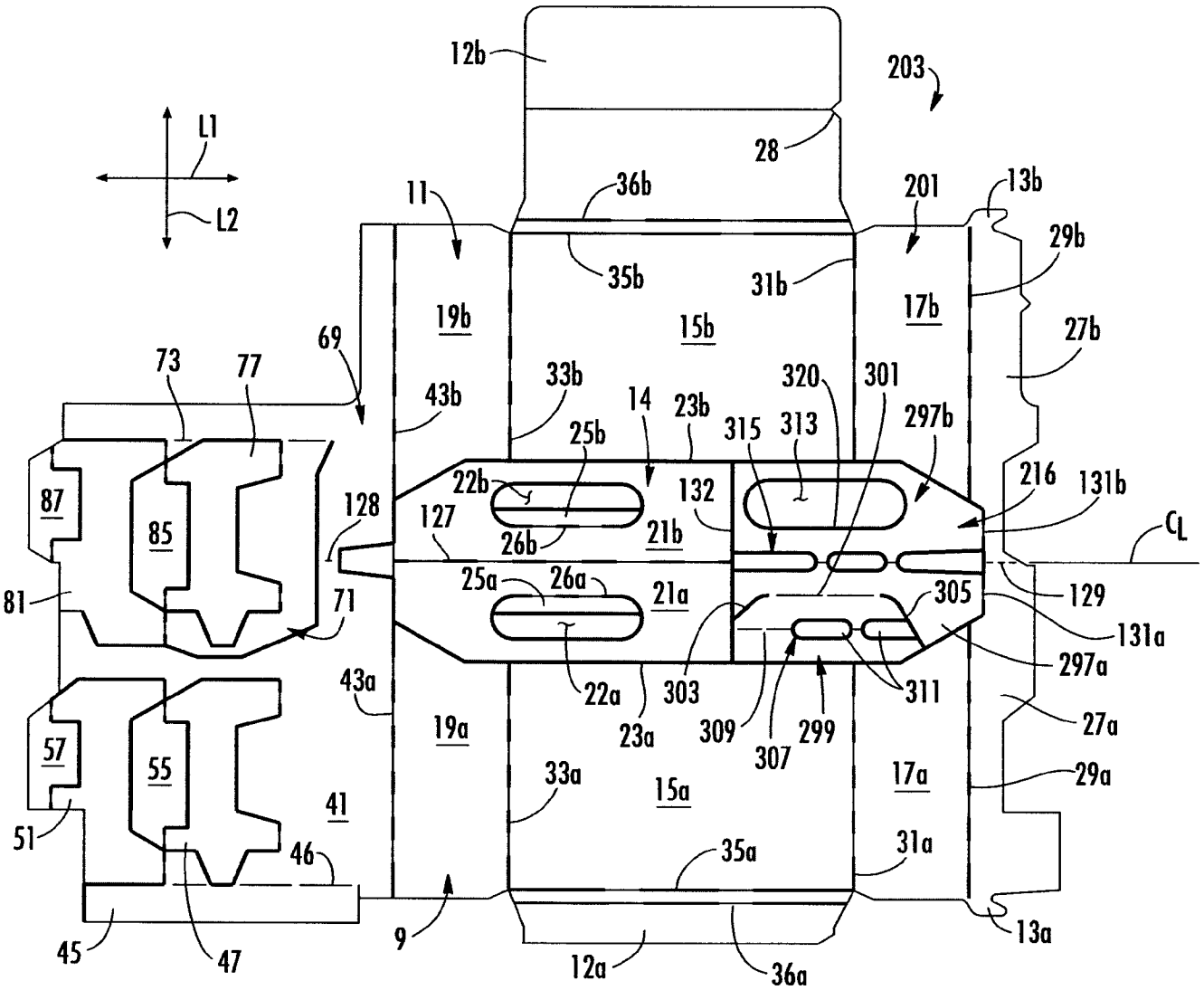
FIG. 6 is an exterior plan view of a blank used to form a carrier according to a second embodiment of the disclosure.
Figure 7:
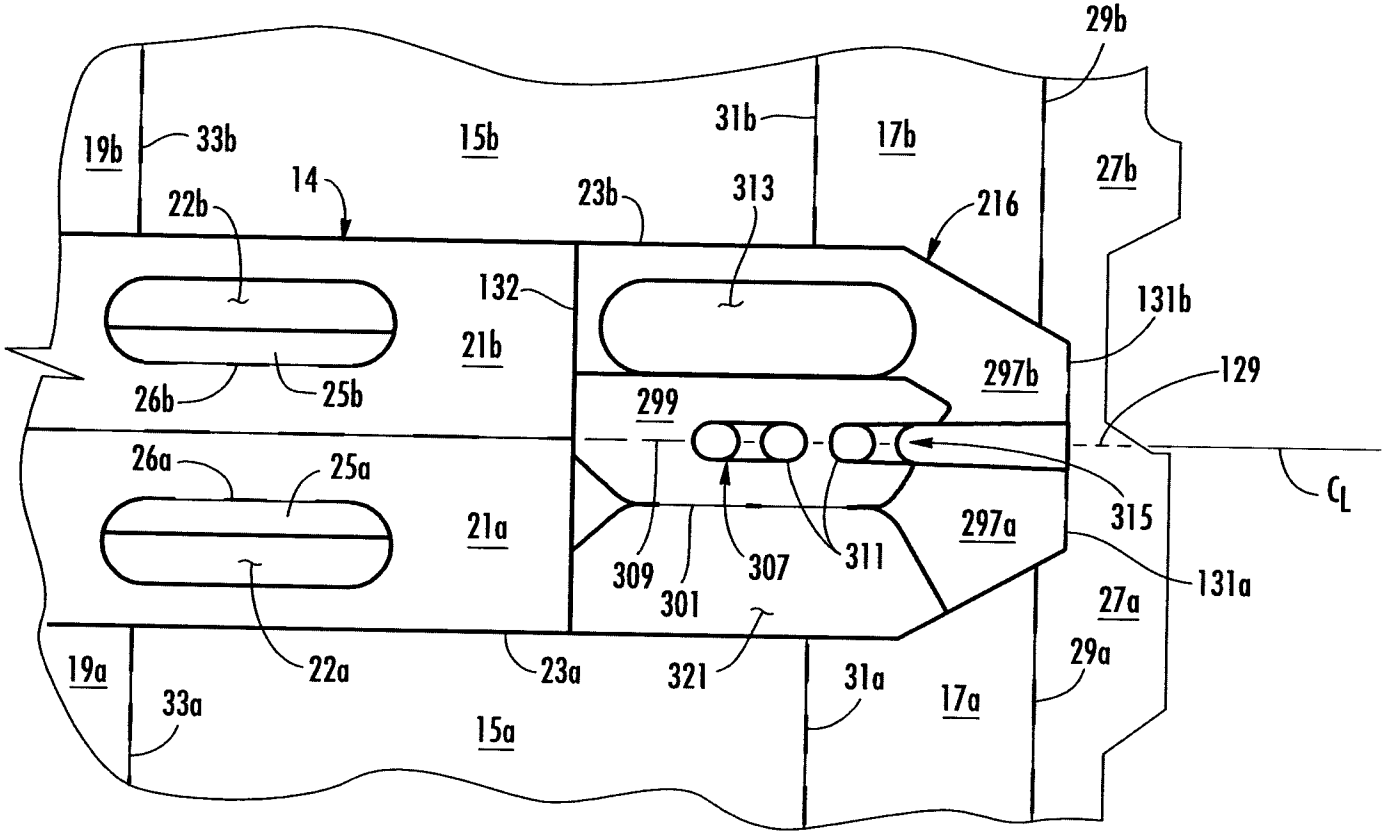
FIG. 7 is a plan view of a reinforcement panel of the blank of FIG. 6 after folding a reinforcement flap according to the second embodiment.

FIG. 6 is a plan view of an exterior surface 201 of a blank 203 for forming a carrier (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the blank 203 includes a handle reinforcement panel 216 with a front handle reinforcement portion 297*a*, a back handle reinforcement portion 297*b*, and a handle reinforcement flap 299. The handle reinforcement flap 299 is shaped differently than the handle reinforcement flap of the first embodiment. In the embodiment of FIG. 2, the handle reinforcement flap 299 includes a line of weakening 307 that comprises a fold line 309 and two openings 311. Additionally, the line of weakening 315 between the front and back handle reinforcement portions comprises a series of openings and fold lines. The handle reinforcement flap 299 omits the central handle cushion flap 117 included in the first embodiment, and is sized and positioned so that an edge of the handle reinforcement flap is aligned with the upper edge 320 of the handle opening 313 when the handle reinforcement flap is folded along the longitudinal fold line 301 (FIG. 7). As shown in FIG. 7, the openings 311 can be offset in the longitudinal direction L1 from the openings of the line of weakening 315. Folding the handle reinforcement flap 299 into contact with the handle reinforcement panel 216 forms an opening or recess 321 in the front handle reinforcement portion 297*a*. The blank 203 could be otherwise shaped, arranged, and/or configured without departing from the disclosure.

Figure 8:
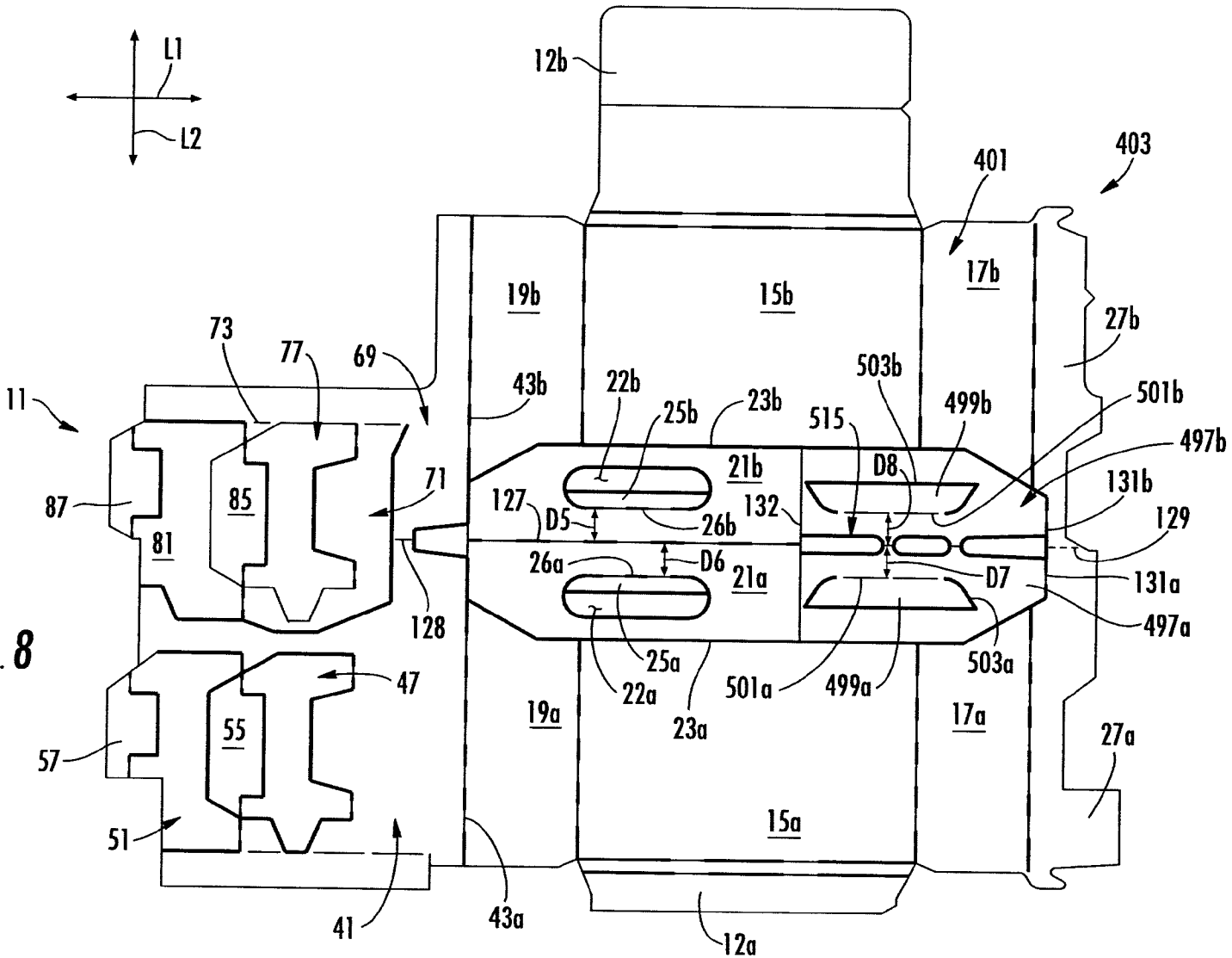
FIG. 8 is an exterior plan view of a blank used to form a carrier according to a third embodiment of the disclosure.

FIG. 8 is a plan view of an exterior surface 401 of a blank 403 for forming a carrier (not shown) according to a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. As shown in FIG. 8, the blank 403 has a front handle reinforcement portion 497*a* that comprises a front handle reinforcement flap 499*a*, and a back handle reinforcement portion 497*b* that comprises a back handle reinforcement flap 499*b*. The handle reinforcement flaps 499*a*, 499*b* are foldably connected to a respective handle reinforcement portions 497*a*, 497*b* at a respective longitudinal fold line 501*a*, 501*b* and are separable from the respective handle reinforcement portions 497*a*, 497*b* along respective tear lines or cuts 503*a*, 503*b*. As illustrated in FIG. 8, the longitudinal fold line 501*a* is spaced apart from a fold line portion of the line of weakening 515 a distance D7, which is generally equal to the distance D6 between longitudinal fold lines 26*a*, 127. Similarly, the longitudinal fold line 501*b* is spaced apart from the fold line portion of the line of weakening 515 a distance D8, which is generally equal to the distance D5 between longitudinal fold lines 26*b*, 127. Alternatively, the distances D7, D8 can be different than the respective distances D6, D5. In the third embodiment, the six-ply handle comprises six plies or layers of material that include the folded over reinforcement flaps 499*a*, 499*b*, the front handle reinforcement portion 497*a*, the back handle reinforcement portion 497*b*, the front handle portion 21*a*, and the back handle portion 21*b*.

Figure 9:
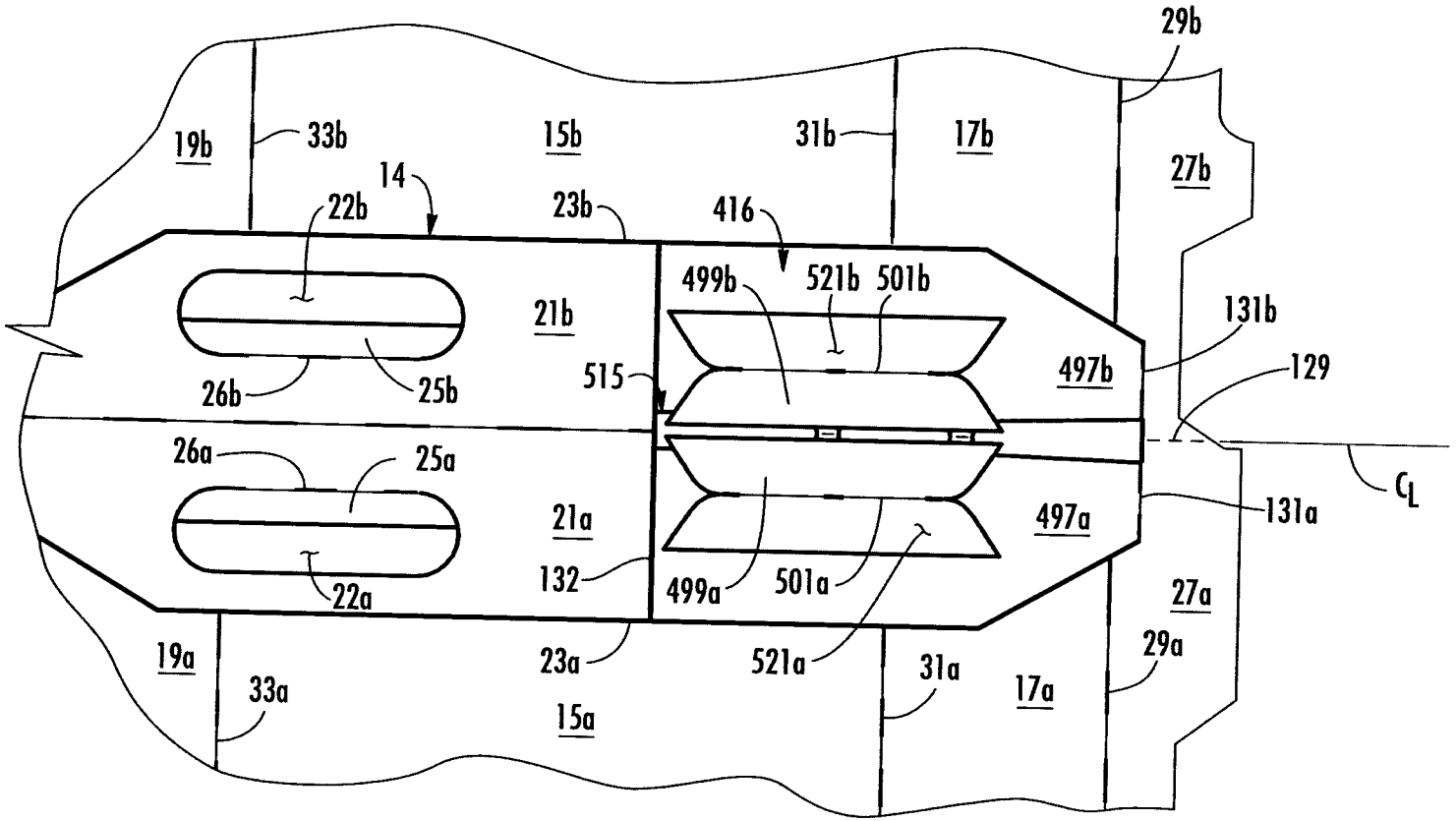
FIG. 9 is a plan view of a reinforcement panel of the blank of FIG. 8 after folding two reinforcement flaps according to the third embodiment.

As shown in FIG. 9, the handle reinforcement flaps 499*a*, 499*b* can be folded along the respective longitudinal fold lines 501*a*, 501*b*. Accordingly, in FIG. 9, the front handle reinforcement flap 499*a* is in face-to-face contact with the front handle reinforcement portion 497*a* and overlays at least a portion of the line of weakening 515. Similarly, the back handle reinforcement flap 499*b* is in face-to-face contact with the back and overlays at least a portion of the line of weakening 515. Alternatively, the line of weakening 515 is a longitudinal fold line, and the respective edges of the front and back handle reinforcement flaps 499*a*, 499*b* are positioned adjacent the longitudinal fold line. The handle reinforcement flaps 499*a*, 499*b* can be folded into contact with the interior or exterior surface of the respective handle reinforcement portions 497*a*, 497*b*. When the reinforced handle is formed similarly to the formation of the handle 150 of the first embodiment, for example, the front handle reinforcement portion 497*a* overlaps the front handle portion 21*a* so that the fold line 501*a* is generally aligned with and at least partially overlays the fold line 26*a*, and the back handle reinforcement portion 497*b* overlaps the back handle portion 21*b* so that the fold line 501*b* is generally aligned with and at least partially overlays the fold line 26*b*. Accordingly, the handle cushion flaps 25*a*, 25*b* can pivot along the respective fold lines 26*a*, 26*b* into the handle openings 521*a*, 521*b*. The reinforced handle of the carrier could be otherwise shaped, arranged, and/or configured without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier or carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that extend at least partially around an interior of the carrier, the plurality of panels comprising at least one bottom panel, a front panel, a back panel, and at least two side panels, the interior of the carrier being divided into a front portion and a back portion; and a reinforced handle comprising a handle panel, a handle reinforcement panel at least partially overlapping the handle panel, and a handle reinforcement flap at least partially in face-to-face contact with the handle reinforcement panel, wherein:

the handle reinforcement panel comprises a front handle reinforcement portion foldably connected to a back handle reinforcement portion along a first longitudinal fold line;

the handle panel comprises a front handle portion foldably connected to a back handle portion along a second longitudinal fold line that generally overlays at least a portion of the first longitudinal fold line; and the handle reinforcement flap comprises a third longitudinal fold line that generally overlays at least a portion of the first longitudinal fold line of the handle reinforcement panel so that at least a portion of the handle reinforcement flap is in face-to-face contact with each of the front and back handle reinforcement portions.

2. The carrier of claim 1, wherein:

the handle reinforcement flap is foldably connected to the front handle reinforcement portion along a fourth longitudinal fold line;

the back handle reinforcement portion comprises a handle opening; and at least a portion of the handle reinforcement flap is in face-to-face contact with the handle reinforcement panel at least between the first longitudinal fold line of the handle reinforcement panel and the handle opening in the back handle reinforcement portion.

3. The carrier of claim 2, wherein:

the front handle portion comprises a front handle opening that is generally aligned with the handle opening of the back handle reinforcement portion, the front handle opening comprising an edge;

at least a portion of the edge of the front handle opening overlays at least a portion of the fourth longitudinal fold line connecting the handle reinforcement flap to the handle reinforcement panel; and the back handle portion comprises a back handle opening that is generally aligned with the front handle opening and the handle opening of the back handle reinforcement portion.

4. The carrier of claim 3, wherein:

the handle reinforcement flap comprises a central handle cushion flap extending adjacent the handle opening of the back handle reinforcement portion;

each of the front and back handle portions comprises a respective front handle cushion flap and a back handle cushion flap, the front and back handle cushion flaps extending adjacent the respective front and back handle openings; and the front handle cushion flap is foldably connected to the front handle portion along the edge of the front handle opening.

* * * * *